United States Patent [19]

Hoffman et al.

[11] Patent Number: 4,476,785

[45] Date of Patent: Oct. 16, 1984

[54] SABOT PROJECTILE

[75] Inventors: Dietrich Hoffman, Schramberg; Udo Götz, Trossingen, both of Fed. Rep. of Germany

[73] Assignee: Mauser-Werke Oberndorf GmbH, Fed. Rep. of Germany

[21] Appl. No.: 405,376

[22] Filed: Aug. 5, 1982

[30] Foreign Application Priority Data

Aug. 8, 1981 [DE] Fed. Rep. of Germany ..... 3131540

[51] Int. Cl.[3] ..... F42B 13/16

[52] U.S. Cl. ..... 102/522

[58] Field of Search ..... 102/501, 517, 518, 519, 102/520, 521, 522, 523-528

[56] References Cited

U.S. PATENT DOCUMENTS

Re. 1,207 7/1861 Hotchkiss ..... 102/525

3,446,147 5/1969 Engel et al. ..... 102/522

3,731,630 5/1973 Muller ..... 102/525 X 3,803,975 4/1974 Elmore et al. ..... 102/430

3,951,071 4/1976 Germershausen ..... 102/523

*Primary Examiner*—Harold J. Tudor

*Assistant Examiner*—Tyrone Davis

*Attorney, Agent, or Firm*—McGlew and Tuttle

[57] ABSTRACT

In a sabot projectile, a projectile core is held fast in a sabot. To the outside of the sabot a hood engaging over the projectile core is secured. To obtain a tight seal of the hood on the sabot by simple measures, particularly without a thread, the shell of the hood is designed with a sealing rim applying against a smooth annular zone of the sabot. Webs of the hood extend beyond the sealing rim. On their free ends, they are provided with inwardly projecting snap noses which engage a recess of the sabot.

2 Claims, 2 Drawing Figures

SABOT PROJECTILE

FIELD AND BACKGROUND OF THE INVENTION

The present invention relates in general to projectiles and in particular to a new and useful projectile including a core and hood.

Such a sabot projectile is disclosed in German Pat. No. 21 31 084. The hood there provided is threaded and screwed to the sabot. The sabot is usually made of aluminum. The required thread is therefore expensive. The hood is made of a tough resilient plastic. Consequently, the provision of a thread on the hood is also costly. In addition, the threads complicate the mounting of the hood on the sabot, particularly since they must be long enough to ensure the necessary stability and sealing.

U.S. Pat. No. 3,148,472 discloses a sabot, which at the same time forms a hood for the head of a projectile core. No mechanical connection between the sabot and the hood is needed in this design. A special method of mounting is provided. The quality of the material of the hood is predetermined by that needed for the sabot. This construction is also expensive.

SUMMARY OF THE INVENTION

The present invention is directed to a sabot projectile of the above mentioned kind which provides a tight connection between the hood and the sabot without the use of threads.

Accordingly, an object of the present invention is to provide a projectile which comprises a sabot having a front end with an annular sealing zone and at least one recess, a projectile core retained in the sabot and a hood secured to the sabot and over the core. The hood comprises a shell having a sealing rim extending therefrom and engaged against the annular sealing zone and a plurality of webs extending radially outwardly of the hood defining grooves therebetween and each including a rearwardly and radially inwardly extending nose which engages the at least one recess of the sabot to retain the hood on the sabot.

Another object of the invention is to provide such a projectile wherein the sealing rim extends outwardly of the shell and engages the annular sealing noze which is tapered.

Another object of the invention is to provide the sealing rim with a toroidal protrusion which engages a circular groove defined in the sabot.

Another object of the invention is to provide a sabot projectile which is simple in design, rugged in construction and economical to manufacture.

A firm and tight seat of the hood on the sabot is thereby obtained. No thread is needed, neither on the hood nor on the sabot. The hood can be fixed to the sabot by simply engaging it thereover.

In a preferred embodiment of the invention, the sealing rim sticks out from the shell. This improves the elastic engagement of the sealing rim on the annular zone, without requiring narrow tolerances between the sealing rim and the snap noses.

In a development of the invention, a leading incline is provided on the sabot surface facing the hood. While engaging the hood on the sabot, the snap noses slide on the incline until they snap into the circular groove. No auxiliary means for spreading the noses are needed.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
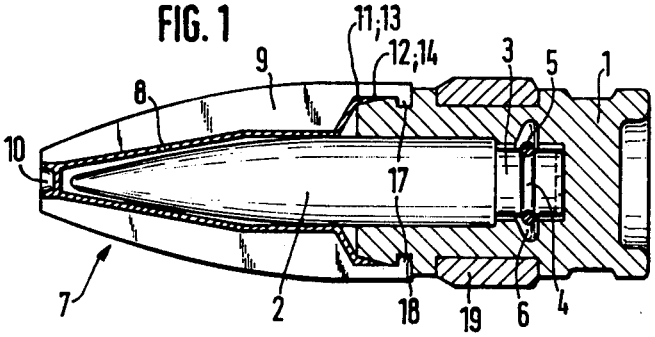
FIG. 1 is a sectional view of a sabot projectile according to the invention.

Referring to the drawings, the invention embodied therein comprises a projectile core 2 which is inserted in the sabot 1. Core 2 is tapered at 3 in its rear portion. Within the zone of the taper or small diameter portion 3 a groove 4 is provided in which a spring ring 5 is received. Sabot 1 is provided with a recess 6 into which spring ring 5 protrudes.

Engaged on sabot 1 is a hood 7 comprising a shell 8, and webs or fins 9 on the outside thereof. An air scoop 10 is formed at the front of shell 8. On its side facing sabot 1, shell 8 terminates in a sealing rim 11. In this embodiment, the sealing rim sticks out radially from shell 8. Sealing rim 11 applies against a smooth zone 12 of sabot 1. According to FIG. 1, sealing rim 11 is formed by a lip 13 engaging a leading incline 14 of sabot 1. In the embodiment of FIG. 2, sealing rim 11 is formed by a toric or annular protrusion 15 which engages a circular groove 16 provided in the front surface of sabot 1.

Webs 9 project rearwardly beyond shell 8 and are formed on their ends with inwardly extending snap noses 17 which engage a recess 18 provided on sabot 1. Recess 18 may be formed by a circumferential groove, however, an individual recess 18 for each snap nose may also be provided.

In addition, a rotating band 19 is provided on sabot 1.

The sabot projectile described in the foregoing is assembled substantially as follows:

Upon inserting spring ring 5 into recess 6, projectile core 2 is inserted into sabot 1 until spring ring 5 snaps into groove 4. Since groove 4 is located in the zone of taper 3, it does not significantly affect the flow about projectile core 2. Due to taper 3, the diameter of groove 4 may remain constant for a variety of projectile core calibers. Therefore, identical springs rings can be used for projectile cores having different calibers.

With the projectile core received in sabot 1, the hood 7 which is made of a tough resilient plastic, is engaged over projectile core 2. During this operation, the snap noses 17 slide on leading incline 14 and then snap into recess 18. This is due to the resilient nature of the web material.

In this position, lip 13 is firmly pressed against incline 14 (FIG. 1), or toric protrusion 15 is firmly pressed into circular groove 16 (FIG. 2). Lip 13 or protrusion 15 are thereby prestressed to a certain degree.

Hood 7 and sabot 1 protect projectile core 2 during storage and, particularly, also during handling. In a barrel for firing the projectile, hood 7 centers the projectile. The translational and rotary motion of the projectile is transmitted to the core 2 only through sabot 1.

After the firing, hood 7 breaks up and thus separates from sabot 1. Due to the spin, spring ring 5 expands, so that projectile core 2 disengages from sabot 1.

Figure 2:
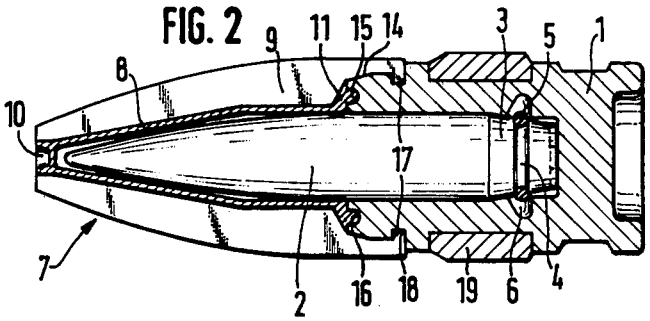
FIG. 2 is a similar view of another embodiment of the invention.

As shown in FIG. 1, portion 3 may be of uniform smaller diameter or, as shown in FIG. 2, it may taper conically.

While specific embodiments of the invention have been shown and described in detail to illustrate the application of the principles of the invention, it will be understood that the invention may be embodied otherwise without departing from such principles.

We claim:

1. A sabot projectile comprising:

a sabot having a front end face, a smooth tapered annular zone extending rearwardly from said front end face and a circular groove to the rear of said annular zone;

a projectile core retained in said sabot and having a front end; and a hood secured to said sabot over said front end of said projectile core, said hood comprising a shell completely enclosing said front end of said projectile core and having a rearwardly and outwardly extending resilient sealing rim extending around said core and engaged against said annular zone, said hood including a plurality of axially extending webs extending outwardly of said shell and defining axially extending grooves therebetween, each of said webs and each of said grooves extending axially rearwardly of said resilient sealing rim and each of said webs including a rearwardly inwardly extending nose clampingly engaged in said circular groove of said sabot for pressing said resilient sealing rim against said annular zone.

2. A sabot projectile comprising:

a sabot having a front end face with an annular groove therein, a smooth tapered annular zone extending rearwardly of said front end face and a circular groove to the rear of said annular zone;

a projectile core retained in said sabot and having a front end; and a hood secured to said sabot and over said front end of said projectile core, said hood comprising a shell completely enclosing said front end of said projectile core and having a rearward and outwardly extending resilient sealing rim extending around said core, said resilient sealing rim having a toric portion sealingly engaged in said annular groove, said hood including a plurality of axially extending webs extending outwardly of said shell and defining axially extending grooves therebetween, each of said webs and each of said grooves extending axially rearwardly of said sealing rim and each of said webs including a rearward inwardly extending nose clampingly engaged in said circular groove of said sabot for pressing said resilient sealing ring against said front end face of said sabot.

* * * * *